US011439246B2

(12) United States Patent
Hall et al.

(10) Patent No.: US 11,439,246 B2
(45) Date of Patent: Sep. 13, 2022

(54) EXTENDABLE SOFA

(71) Applicant: Hall Labs LLC, Provo, UT (US)

(72) Inventors: David R. Hall, Provo, UT (US); Cody Rees, Provo, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/911,104

(22) Filed: Jun. 24, 2020

(65) Prior Publication Data

US 2020/0405066 A1 Dec. 31, 2020

Related U.S. Application Data

(60) Provisional application No. 62/866,603, filed on Jun. 25, 2019.

(51) Int. Cl.

| | |
|---|---|
| ***A47C 1/02*** | (2006.01) |
| ***A47C 17/13*** | (2006.01) |
| ***A47C 1/023*** | (2006.01) |
| *A47C 1/024* | (2006.01) |
| *A47C 17/86* | (2006.01) |

(52) U.S. Cl.

CPC ..... *A47C 17/132* (2013.01); *A47C 1/023* (2013.01); *A47C 1/024* (2013.01); *A47C 17/86* (2013.01)

(58) Field of Classification Search

CPC ..... A47C 1/023; A47C 1/024; A47C 17/132; A47C 17/86

See application file for complete search history.

(56) References Cited

U.S. PATENT DOCUMENTS

| | | | | |
|---|---|---|---|---|
| 1,327,941 A * | 1/1920 | Camp | A47B 67/00 5/58 |
| 1,721,647 A * | 7/1929 | Stoltenberg | A47C 17/132 5/18.1 |
| 3,505,694 A * | 4/1970 | Pesta | A47C 17/04 5/17 |
| 2018/0271294 A1* | 9/2018 | Chiriac | A47C 13/005 |

* cited by examiner

*Primary Examiner* — Syed A Islam

(57) ABSTRACT

There is disclosed an extendable sofa comprising a frame having a seat support portion, a back-support portion, and a cushion storage compartment, wherein the frame is adapted to extend and collapse length-wise between a collapsed configuration and an extended configuration. A primary seat cushion adapted to rest upon the seat support portion of the frame when in the frame is in the collapsed configuration. An auxiliary seat cushion adapted to be stored in the cushion storage compartment when the frame is in the collapsed configuration and adapted to rest upon the seat support portion when the frame is in the extended configuration. At least one primary back cushion adapted to rest against the back-support portion of the frame when the frame is in the collapsed configuration. At least one auxiliary back cushion adapted to be stored in the cushion storage compartment when the frame is in the collapsed configuration and adapted to rest against the back-support portion when the frame is in the extended configuration.

14 Claims, 7 Drawing Sheets

140

EXTENDABLE SOFA

TECHNICAL FIELD

This invention is related to sofas and more specifically to extendable sofas.

BACKGROUND

Space for housing can be at a premium as, for example, more young people choose to live in smaller spaces, choosing apartment living to owning a home. Additionally, environmental factors, may push ever more people into smaller spaces as cities grow. Housing needs of the future may require solutions to living sustainably both in how we use goods and how we utilize space. It is important therefore to find solutions to utilize space as efficiently as possible.

Currently rooms are typically designed in such a way that each room performs a specific function. There are typically separate rooms for eating, sleeping and entertaining. A more efficient solution may be to make rooms multifunctional.

SUMMARY

In a first aspect, the invention is an extendable sofa comprising a frame having a seat support portion, a back-support portion, and a cushion storage compartment, wherein the frame is adapted to extend and collapse length-wise between a collapsed configuration and an extended configuration. A primary seat cushion adapted to rest upon the seat support portion of the frame when in the frame is in the collapsed configuration. An auxiliary seat cushion adapted to be stored in the cushion storage compartment when the frame is in the collapsed configuration and adapted to rest upon the seat support portion when the frame is in the extended configuration. At least one primary back cushion adapted to rest against the back-support portion of the frame when the frame is in the collapsed configuration. At least one auxiliary back cushion adapted to be stored in the cushion storage compartment when the frame is in the collapsed configuration and adapted to rest against the back-support portion when the frame is in the extended configuration.

In a second aspect, the invention is an extendable sofa, which includes a frame with a seat support portion, a back-support portion, and a cushion storage compartment. The frame is adapted to extend and collapse length-wise between a collapsed configuration, a partially extended configuration and a fully extended configuration. The frame includes a seat support portion adapted to accommodate at least one primary seat cushion resting upon the seat support portion of the frame when the frame is in the collapsed configuration and adapted to accommodate two adults. The sofa also includes a first auxiliary seat cushion adapted to be stored in the cushion storage compartment when the frame is in the collapsed configuration and adapted to rest upon the seat support portion of the frame when the frame is in the partially extended configuration and the fully extended configuration. The sofa further includes a second auxiliary seat cushion adapted to be stored in the cushion storage compartment when the frame is in the collapsed configuration and in the partially extended configuration and adapted to rest upon the seat support portion of the frame when the frame is in the fully extended configuration. The frame also has a back support portion adapted to accommodate at least one primary back cushion resting upon the seat support portion of the frame when the frame is in the collapsed configuration and adapted to accommodate two adults. The sofa also includes a first auxiliary back cushion adapted to be stored in the cushion storage compartment when the frame is in the collapsed configuration and adapted to rest upon the back support portion of the frame when the frame is in the partially extended configuration and the fully extended configuration. Finally, the sofa includes a second auxiliary back cushion adapted to be stored in the cushion storage compartment when the frame is in the collapsed configuration and in the partially extended configuration and adapted to rest upon the back support portion of the frame when the frame is in the fully extended configuration.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 2:
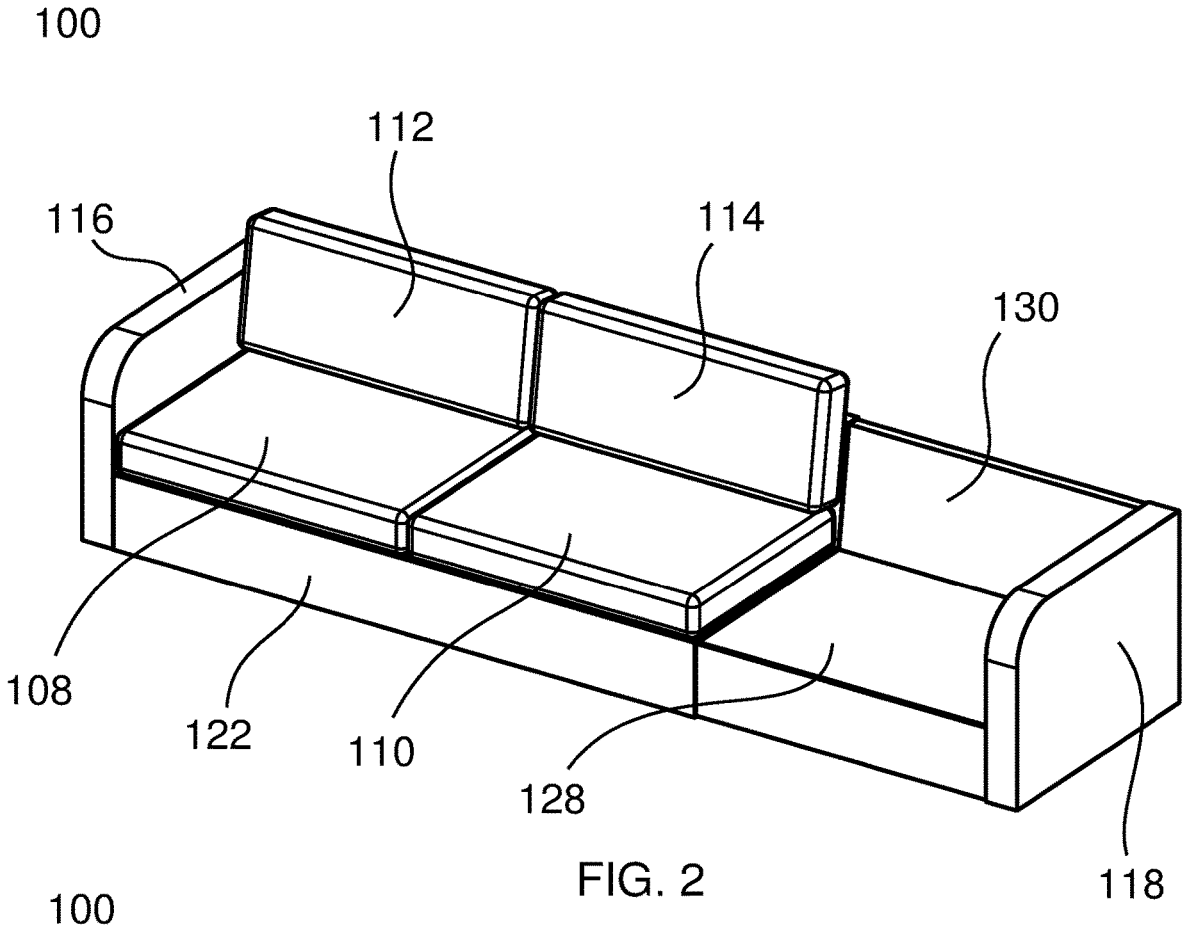
FIG. 2 is a perspective view of a sofa extended with three seating portion.
Figure 1:
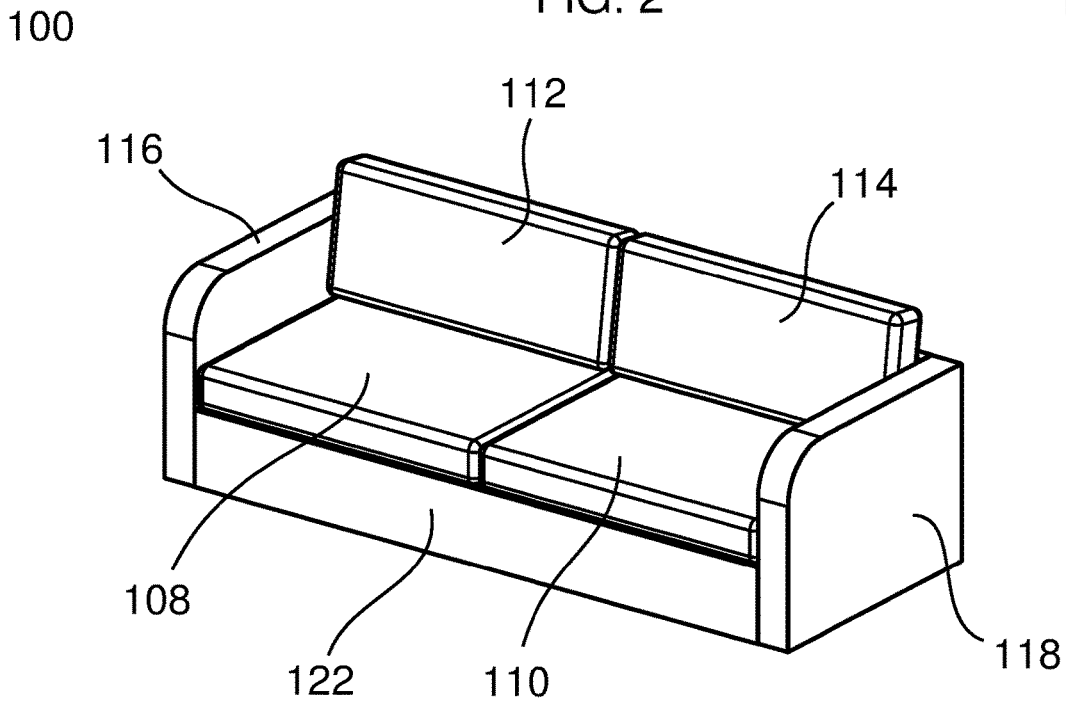
FIG. 1 is a perspective view of a sofa with two seating portions.
Figure 3:
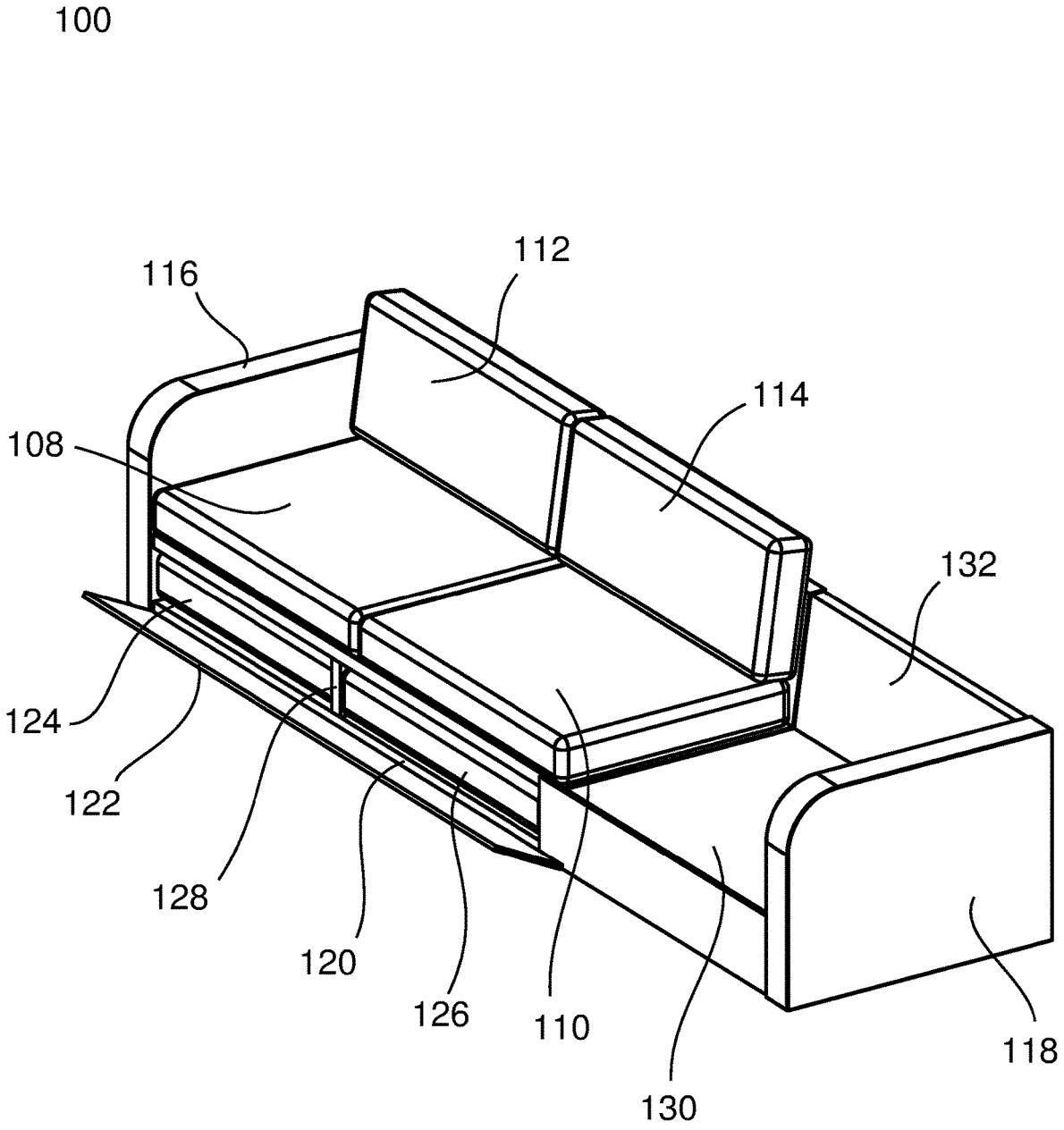
FIG. 3 is a perspective view of a sofa extended with three seating portions.
Figure 4:
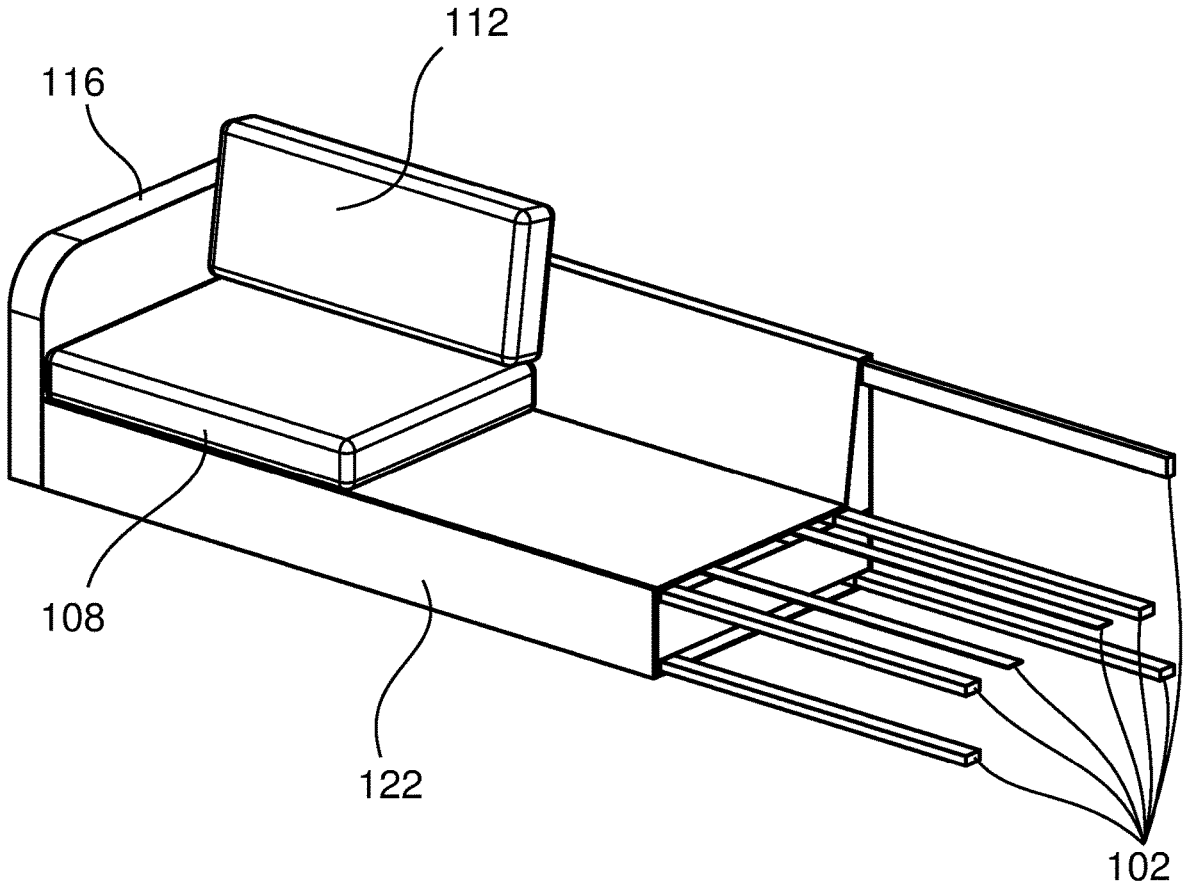
FIG. 4 is a perspective view of a sofa with an internal view of frame members.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "sofa" is meant to refer to a piece of furniture with a backing and place for seating, typically for seating between two and four people.

As used herein, "extendable" is meant to refer to something with the capability of being lengthened without being damaged.

As used herein, "collapsible" is meant to refer to something with the capability of being shortened without being damaged.

As used herein, "frame" is meant to refer to a rigid structure that gives support and/or shape.

As used herein "elongate" is meant to refer to something that is longer in a spatial dimension in relation to its height or width.

As used herein "cushion" is meant to refer to a pillow or pad typically formed of soft material that may provide comfort while seated.

As used herein "armrest" is meant to refer to a raised feature found on seating designed to allow an occupant to rest their arm.

The extendable sofa of the present invention has value when used in small spaces, whether residential or commercial. For example, it will find use in small apartments and houses with limited space. It will also find use in commercial spaces, such as office, waiting rooms and hotels. In such spaces, it may be desirable to have a sofa that can be collapsed so as to provide room for other furniture, appliances or activities. Then, if additional seating is needed, the sofa can be extended to accommodate it.

One particularly advantageous application for the extended sofa is for use in reconfigurable spaces, i.e. spaces that are designed to accommodate different uses at different time by reconfiguring the space for those uses. A company at the forefront of developing such reconfigurable spaces is Adaptive XYZ, located in Provo, Utah. Some of the patents directed to the concepts for these reconfigurable spaces are U.S. Pat. No. 8,402,700, entitled WALL ASSEMBLY COMPRISING PANELS CONFIGURED TO RESIDE IN AN OVERHEAD STRUCTURE; U.S. Pat. No. 9,963,877, entitled MODULAR PRISMATIC BOX-LIKE STRUCTURE-BASED BUILDING METHOD AND INFRASTRUCTURE; U.S. Pat. No. 9,963,873, entitled FLEXIBLE, SOUND-ATTENUATING ROLL-UP WALL SYSTEM; and U.S. Pat. No. 10,196,809, entitled MODULAR BUILDING COMPONENT FOR FLOOR AND CEILING WITH ROD-BASED DIMENSIONS. In some of these applications, the furniture may be removed from the space for certain configurations and reintroduced for other configurations. The preferred solution is to make removal and reintroduction as automated as possible. One solution is to lift the furniture to a space overhead. Another solution is to store the furniture in an underfloor storage system, such as that disclosed in US 2018/0216345, entitled AUTOMATED LIFTING FLOOR FOR UNDERFLOOR STORAGE. The entire disclosures of these patents and published application are incorporated by reference.

In any of these reconfigurable space applications, it is preferred for the furniture to have as small a footprint as possible, yet provide as much functionality, e.g. seating capacity as possible.

Now referring to FIGS. 1-4, an extendable sofa 100 is shown with two seating portions with cushions 108 and 110. The frame comprises sets of elongate frame members 102 located within the sofa shown in FIG. 4 as if the extendable section of the sofa were removed. Elongate frame members 102 may provide support to a person seated on the sofa and may be comprised of various materials such as wood, plastic, or metal. The seating portions are comprised of separate cushions 108 and 110 but may also be comprised of a single cushion. The cushions may comprise any soft or flexible material such as polyester fiber, polyurethane foam, latex foam, or natural material such as coconut fiber, cotton or buckwheat and comprise an outer shell of various materials such as silk, rayon, polyester or cotton fiber or may be comprised of a more rigid material such as wicker or plastic. Back support portions 112 and 114 are comprised of separate cushions but may also be comprised of a single cushion. Armrests 116 and 118 are found on opposing sides of the sofa.

Below the seating area is a cushion storage compartment 120, which, as shown, is located beneath the seat cushion and comprises a door 122. Alternatively, the cushion storage compartment may be located anywhere on or inside the extendable sofa, such as attached to the back of the sofa or on the sides. Within the cushion storage compartment 120 is auxiliary cushion 124 and auxiliary back cushion 126. Shown in this embodiment is a cushion storage separated into two compartments by separator 128. The storage compartment 120 may contain one or more auxiliary cushions such as both an auxiliary seat cushion and auxiliary back cushion. The auxiliary cushions may be stored anywhere within or outside the cushion storage compartment by the user and may even be kept elsewhere such as a closet. Therefore, the cushion storage compartment may be used for other storage needs. When the elongate frame members are extended sofa 100 extends laterally providing extra space for seating 130 and extra backing 132. Auxiliary cushions may then be removed from the cushion storage compartment 120 and placed onto the extra seating or may be placed on the backing providing extra cushioning for the back while seated.

Frame members 102 are made of concentric tubular parts that telescope laterally, which slide into themselves to become smaller or slide out of themselves to become longer in a lateral direction thus causing the extendable couch to collapse or lengthen. When telescoping the frame members 102 the fabric of the seating portion 134 and the fabric of the backing portion 136 also telescope laterally, which slide into themselves to become smaller when frame members 102 are shortened or to slide out of themselves to become longer as frame members 102 are lengthened.

Figure 6:
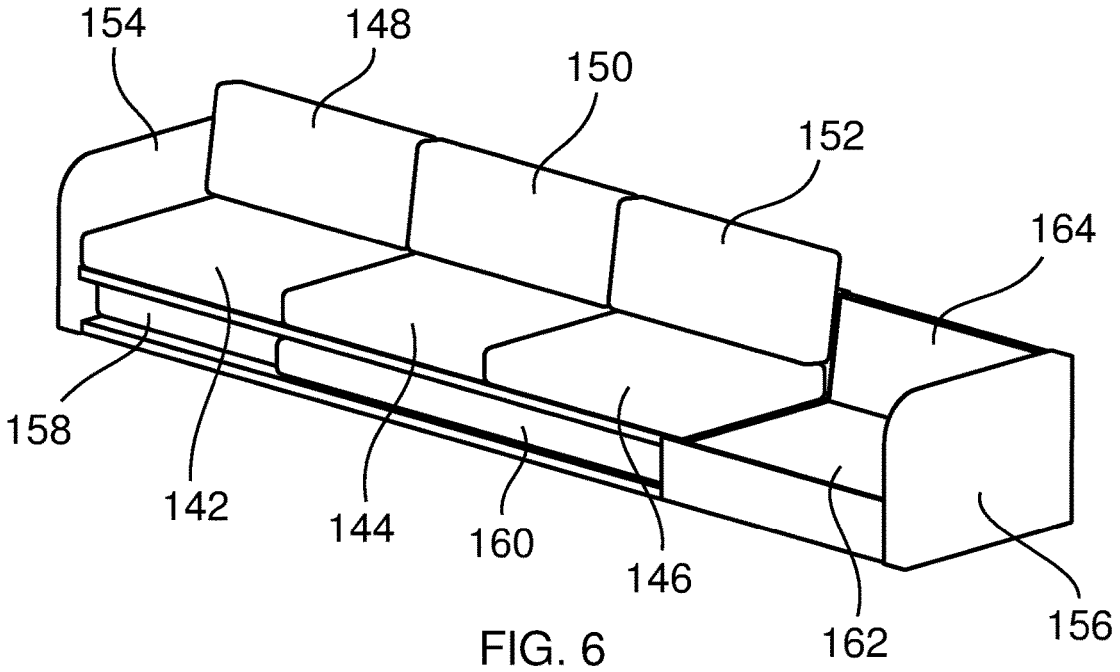
FIG. 6 is a perspective view of a sofa extended with four seating portion.
Figure 5:
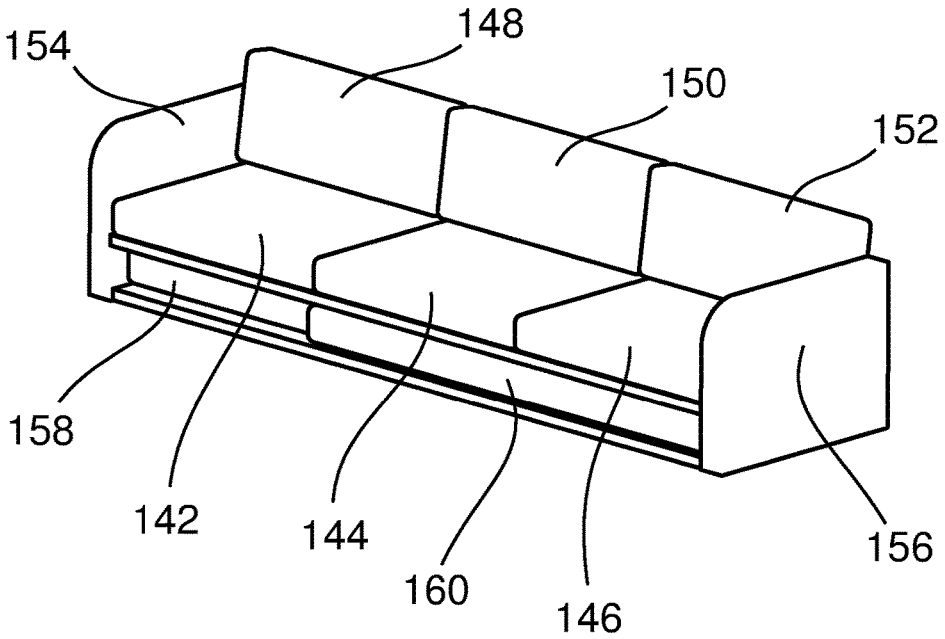
FIG. 5 is a perspective view of a sofa with three seating portions.

Now referring to FIGS. 5 and 6, an extendable sofa 140 is shown with three seating portions with cushions 142, 144, and 146. The seating portions are comprised of separate cushions 142, 144, and 146 but may also be comprised of a single cushion. The cushions may comprise any soft or flexible material such as polyester fiber, polyurethane foam, latex foam, or natural material such as coconut fiber, cotton or buckwheat and comprise an outer shell of various materials such as silk, rayon, polyester or cotton fiber or may be comprised of a more rigid material such as wicker or plastic. Back support portions 148, 150, and 152 are comprised of separate cushions but may also be comprised of a single cushion. The cushions may comprise any soft or flexible material such as polyester fiber, polyurethane foam, latex foam, or natural material such as coconut fiber, cotton or buckwheat and comprise an outer shell of various materials such as silk, rayon, polyester or cotton fiber or may be comprised of a more rigid material such as wicker or plastic. Extendable sofa 140 also comprises armrest 154 and 156.

Bellow the seating area is a cushion storage compartment 158, which, as shown, is located beneath the seat cushion. Alternatively, the cushion storage compartment may be located anywhere on or inside the extendable sofa, such as attached to the back of the sofa or on the sides. Within the cushion storage compartment 158 is auxiliary cushion 160. The storage compartment 158 may contain one or more auxiliary cushions such as both an auxiliary seat cushion and auxiliary back cushion. The auxiliary cushions may be stored anywhere within or outside the cushion storage compartment by the user and may even be kept elsewhere such as a closet. Therefore, the cushion storage compartment may be used for other storage needs. When the extendable sofa 140 extends laterally it provides extra space for seating 162 and extra backing 164. Auxiliary cushion 160 may then be removed from the cushion storage compartment 158 and placed onto the extra seating to provide extra seating and backing for the extendable sofa.

Figure 8:
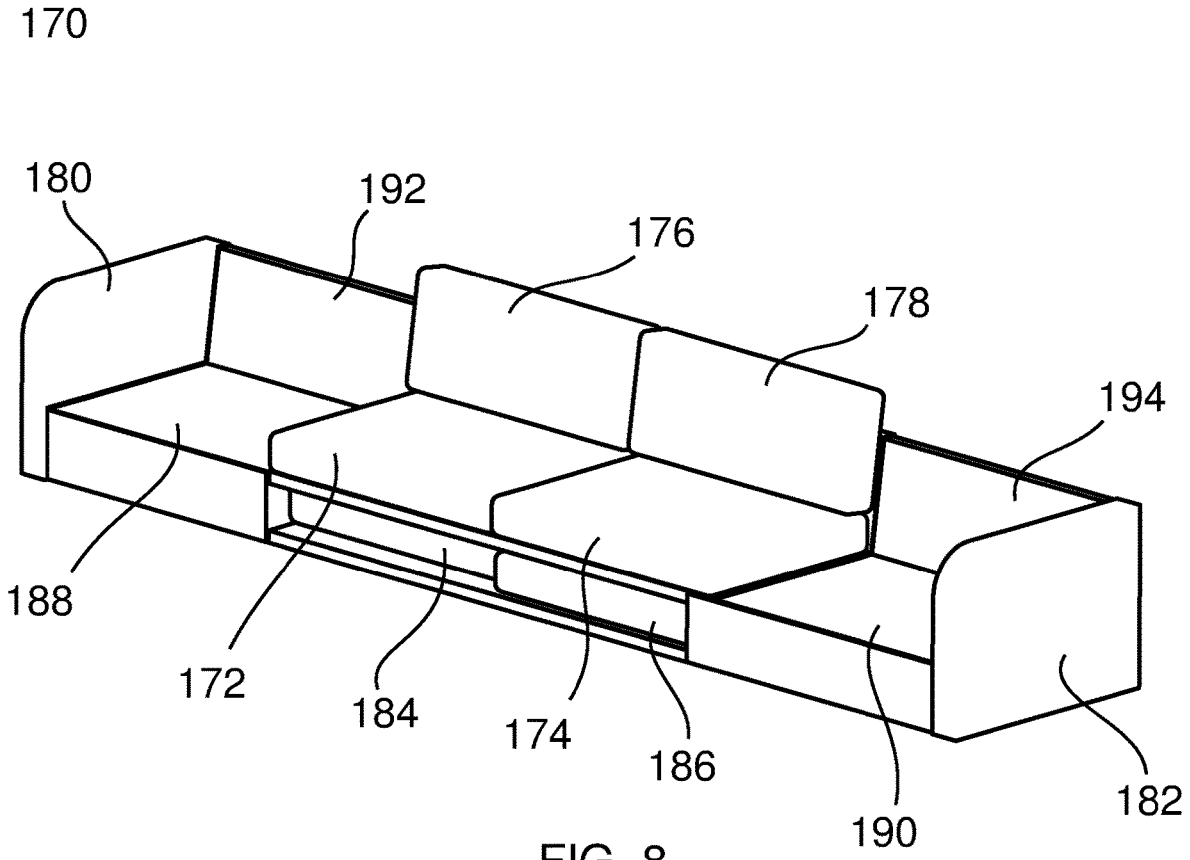
FIG. 8 is a perspective view of a sofa extended with four seating portions.
Figure 7:
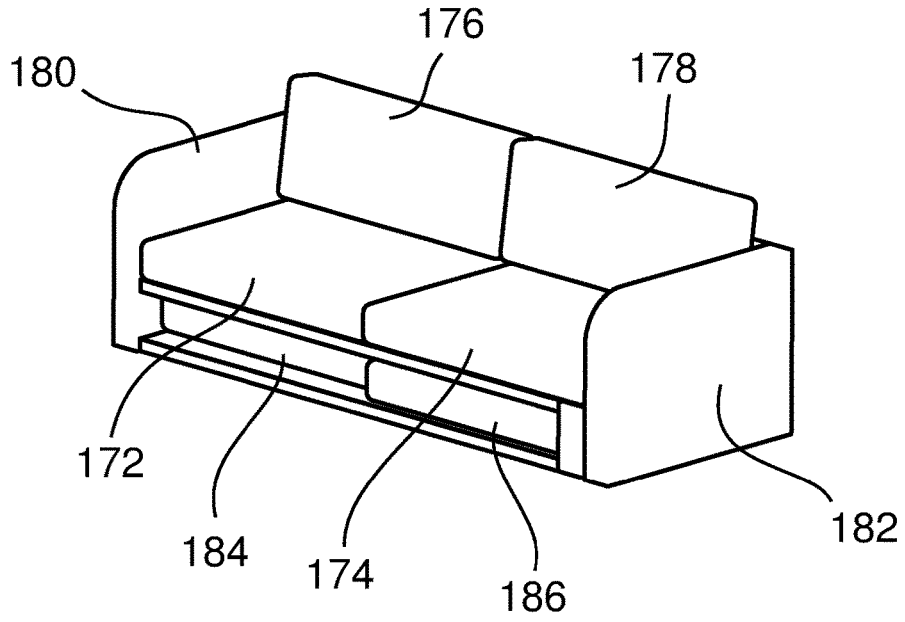
FIG. 7 is a perspective view of a sofa with two seating portions.

Now referring to FIGS. 7 and 8, an extendable sofa 170 is shown with two seating portions with cushions 172 and 174. The seating portions are comprised of separate cushions 172 and 174 but may also be comprised of a single cushion. The cushions may comprise any soft or flexible material such as polyester fiber, polyurethane foam, latex foam, or natural material such as coconut fiber, cotton or buckwheat and comprise an outer shell of various materials such as silk, rayon, polyester or cotton fiber or may be comprised of a more rigid material such as wicker or plastic. Back support portions 176 and 178 are comprised of separate cushions but may also be comprised of a single cushion. Armrests 180 and 182 are found on opposing sides of the sofa.

Below the seating area is a cushion storage compartment 184 however the cushion storage compartment may be located anywhere on or inside the extendable sofa, such as attached to the back of the sofa or on the sides. Within the cushion storage compartment 184 is auxiliary cushion 186. The cushion storage compartment 184 may contain one or more auxiliary cushions such as a cushion for seating and a cushion for backing. The auxiliary cushions may be stored anywhere within or outside the cushion storage compartment by the user and may even be kept elsewhere such as a closet. Therefore, the cushion storage compartment 184 may be used for other storage needs. When the extendable sofa is extended sofa 170 extends laterally in both directions providing two extra spaces 188 and 190 for seating and two extra spaces for backing 192 and 194. Auxiliary cushions may then be removed from the cushion storage compartment 184 and placed onto the extra seating or may be placed on the backing providing extra cushioning for the back while seated.

Figure 9:
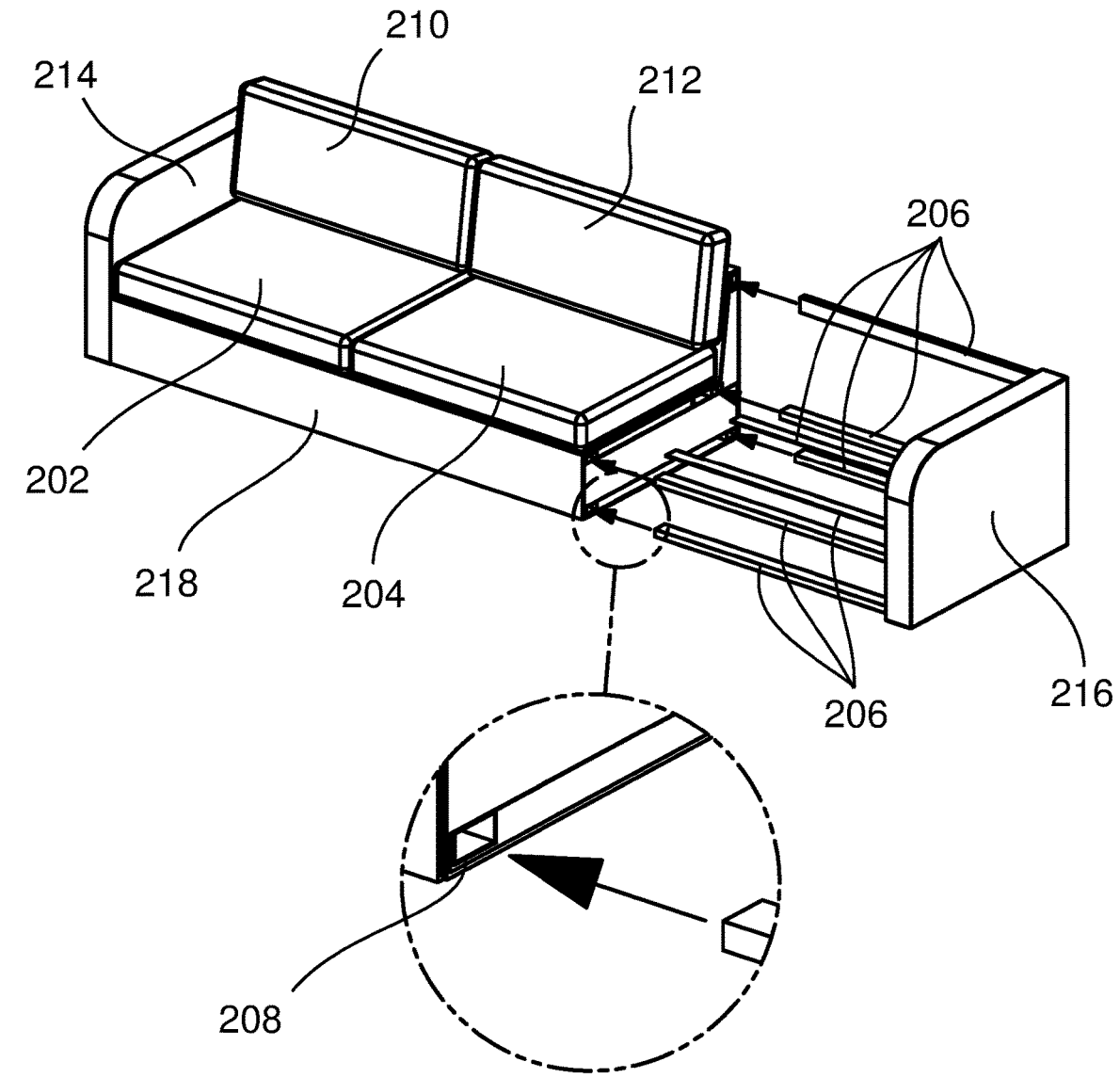
FIG. 9 is a perspective view of a sofa with an internal view of frame members.

Now referring to FIG. 9, an extendable sofa 200 is shown with two seating portions with cushions 202 and 204. Sets of auxiliary elongate frame members 206 provide support to a person seated on the sofa and may be comprised of various materials such as wood, plastics, or metal. Auxiliary frame members 206 may be coupled to the frame of the sofa allowing the user to extend the sofa laterally. Auxiliary frame members 206 are designed to fit into cavity 208 creating an extra seating portion. The seating portion may contain a backing portion or may only comprise a seating portion. The Seating portions are comprised of separate cushions 202 and 204 but may also be comprised of a single cushion. The cushions may comprise any soft or flexible material such as polyester fiber, polyurethane foam, latex foam, or natural material such as coconut fiber, cotton or buckwheat and comprise an outer shell of various materials such as silk, rayon, polyester or cotton fiber or may be comprised of a more rigid material such as wicker or plastic. Back support portions 210 and 212 are comprised of separate cushions but may also be comprised of a single cushion. Armrests 214 and 216 are found on opposing sides of the sofa. Below the seating area is a storage compartment covered by door 218 however the cushion storage compartment may be located anywhere on or inside the extendable sofa, such as attached to the back of the sofa or on the sides. Auxiliary frame members 216 may be kept in the storage compartment when removed from the frame. The auxiliary frame members may be stored anywhere within or outside the storage compartment by the user and may even be kept elsewhere such as a closet. Therefore, the storage compartment may be used for other storage needs such as containing auxiliary cushions for the extra seating portion.

Figure 10:
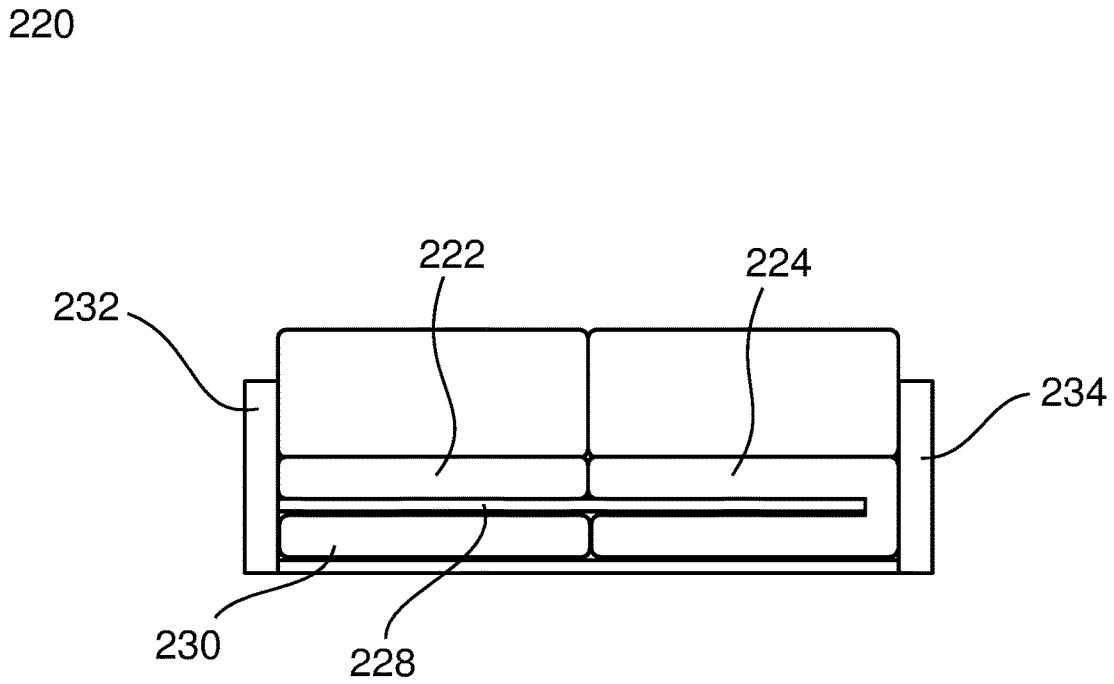
FIG. 10 is a front view of a sofa with two seating portions.
Figure 11:
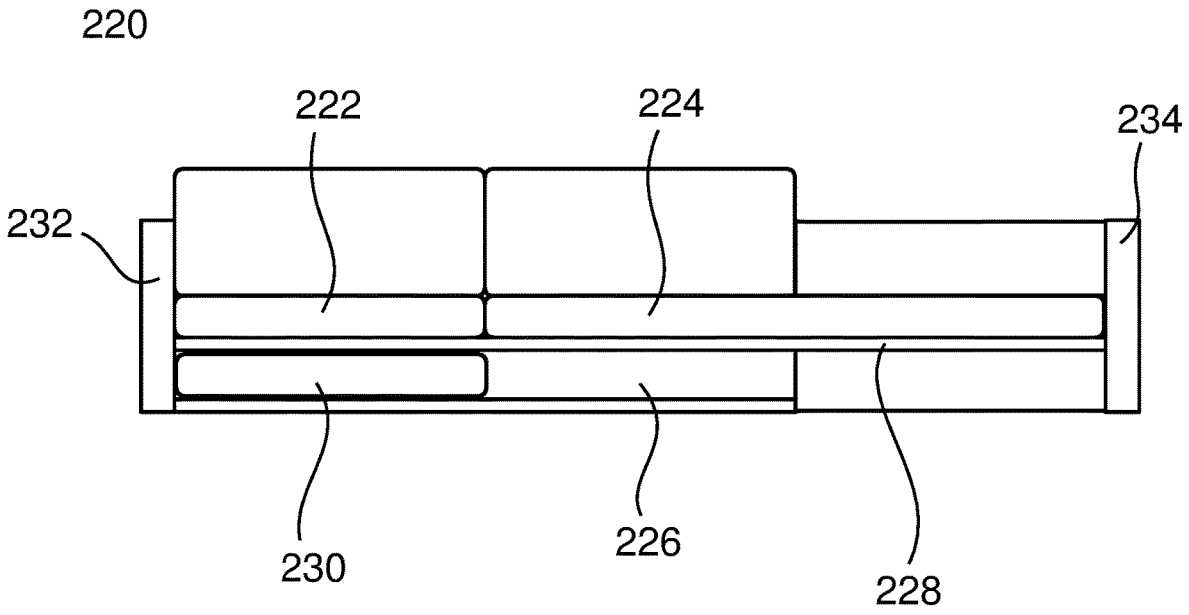
FIG. 11 is a front view of a sofa extended with three seating portions.

Now referring to FIGS. 10 and 11, an extendable sofa 220 with two seating portions with cushions 222 and 224. The cushions may comprise any soft or flexible material such as polyester fiber, polyurethane foam, latex foam, or natural material such as coconut fiber, cotton or buckwheat and comprise an outer shell of various materials such as silk, rayon, polyester or cotton fiber. The outer shell of cushion 222 may also be comprised of a more rigid material such as wicker or plastic. Cushion 224 is tucked under to fit inside cushion storage compartment 226. Sofa 220 comprises frame member 228. When frame member 228 is extended laterally cushion 224 is raised creating extra seating. Frame member 228 may be extended or collapsed laterally by telescoping into or out of itself. Cushion storage compartment 226 may also comprise an auxiliary cushion 230 to place on the back of the extra seating and may also comprise a door to open or close the cushion storage compartment. Cushion storage compartment 226 may also contain auxiliary frame members to attach to the backing to create extra backing or may contain auxiliary frame members to create another extra seating portion on the opposite side of the sofa. Sofa 220 also comprises armrest 232 and 234.

Although the extendable sofa shown has either two or three seating portions with cushions more seating portions may be created such as four or more seating portions that extend to five or more seating portions when extended.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

What is claimed is:

1. An extendable sofa comprising:

a frame having a seat-support portion, a back support portion, and a cushion storage compartment, wherein the frame is adapted to extend and collapse lengthwise between a collapsed configuration and an extended configuration;

a primary seat cushion adapted to rest upon the seat support portion of the frame when the frame is in the collapsed configuration;

an auxiliary seat cushion adapted to roll up into the cushion storage compartment when the sofa is in a collapsed configuration and to unroll when the sofa is in the extended configuration and rest upon the seat support portion when the frame is in the extended configuration;

at least one primary back cushion adapted to rest against the back-support portion of the frame when the frame is in the collapsed configuration;

at least one auxiliary back cushion adapted to be stored in the cushion storage compartment when the frame is in the collapsed configuration and adapted to rest against the back-support portion when the frame is in the extended configuration.

2. The invention of claim 1 wherein the frame comprises a plurality of elongate frame members.

3. The invention of claim 2 wherein the elongate frame members are telescoping to facilitate extension and collapse of the frame.

4. The invention of claim 1 wherein the frame is comprised of two separate series of connected metal parts wherein one series is adapted to extend and collapse lengthwise the back-support portion of the frame and the other is adapted to extend and collapse lengthwise the seat portion of the frame.

5. The invention of claim 1 wherein the extending sofa also comprises an armrest.

6. The invention of claim 1 wherein the cushion storage compartment comprises a door to close the storage compartment.

7. The invention of claim 1 wherein the cushion storage compartment is a first cushion storage compartment and wherein the extendable sofa comprises a second cushion storage compartment.

8. The invention of claim 7 wherein the first cushion storage compartment is adapted to hold the auxiliary seat cushion.

9. The invention of claim 7 wherein the second cushion storage compartment is adapted to hold the auxiliary back cushion.

10. The invention of claim 7 wherein the cushion storage compartment comprises a first door to close the first cushion storage compartment.

11. The invention of claim 7 wherein the second cushion storage compartment comprises a door to close the second cushion storage compartment.

12. The invention of claim 11 wherein the frame is changed from the collapsed configuration to the extended configuration by attaching auxiliary frame members which are stored in the cushion storage compartment when not in use.

13. The invention of claim 1 wherein the extendable sofa is sized to accommodate two adults in the collapsed configuration and sized to accommodate three adults in the extended configuration.

14. The invention of claim 1 wherein the cushion storage compartment comprises multiple chambers.

* * * * *